US005227578A

United States Patent [19]

Reynolds

[11] Patent Number: 5,227,578

[45] Date of Patent: Jul. 13, 1993

[54] WEAPON WITH DISAPPEARING BOLT

[76] Inventor: George L. Reynolds, Rte. 1, Altona, Ill. 51414

[21] Appl. No.: 819,953

[22] Filed: Jan. 13, 1992

[51] Int. Cl.[5] ..... F41A 3/34

[52] U.S. Cl. ..... 89/186; 89/33.2

[58] Field of Search ..... 89/186, 33.14, 33.2, 89/167, 171

[56] References Cited

U.S. PATENT DOCUMENTS

| | | | |
|---|---|---|---|
| 1,451,443 | 4/1923 | Fowler | 89/33.2 |
| 2,476,232 | 7/1949 | Williams | 89/171 |
| 3,221,603 | 12/1965 | Lochhead | 89/33.2 |
| 3,955,469 | 5/1976 | Conley | 89/33.14 |

FOREIGN PATENT DOCUMENTS

| | | | |
|---|---|---|---|
| 607588 | 2/1933 | Fed. Rep. of Germany | 89/186 |
| 228459 | 8/1943 | Switzerland | 89/171 |

*Primary Examiner*—Stephen M. Johnson
*Attorney, Agent, or Firm*—Robert O. Richardson

[57] ABSTRACT

This weapon has an axially moveable bolt which is removed from the path of an incoming cartridge so that the cartridge can be moved from its feed position directly along the axis of the bore into the gun chamber. After the bolt "disappears" from the path of the incoming ammunition, it then reappears behind the cartridge to move it along the barrel axis. This chambers the cartridge without the need for ramping since the cartridge is already aligned with the bore chamber.

6 Claims, 4 Drawing Sheets

WEAPON WITH DISAPPEARING BOLT

BACKGROUND OF THE INVENTION

The present invention relates to a cartridge feeding mechanism for a gun in which the incoming cartridge is fed along the barrel axis and chambered without ramping. This is done by making the bolt "disappear" from the axis of the barrel during chambering of the cartridge.

In prior art semiautomic and automatic gun mechanisms using pushout links, such as the M60 machinegun for example, the cartridge magazine or belt feed mechanism places the cartridge as close to the bore axis as the bolt will permit. This is desirable so there is a least possible angular movement or ramping to the cartridge during chambering. However, a high percentage of gun functioning stoppages occur during chambering of the cartridge from its feed position. This is because the cartridge is difficult to control while making the transition from control by magazine or belt to control by the chamber. Aggravating this condition is the close proximity of the ejection port which provides a potential for loss of proper control by the feed mechanism during chambering.

In other prior art mechanisms, such as used in Browning and Maxim machineguns, the cartridge is extracted rearwardly from the ammunition belt and positively controlled during the chambering, extraction and ejection processes. These mechanisms provide extremely reliable feeding and chambering but they are bulky and require somewhat elaborate loading and unloading procedures which are objectionable from a training and safety viewpoint.

SUMMARY OF PRESENT INVENTION

Most gun stoppages in conventional guns are the direct result of failures to feed, chamber or eject cartridges. This is because the bolt remains on the axis of the bore and the ammunition must be ramped or angled onto the axis of the bore for chambering. Chambering without ramping avoids these failures and makes the gun more reliable. Chambering without ramping is also desirable since ammunition with fragile windshields for protecting sophisticated fuses are coming into increasingly widespread use. By feeding the incoming cartridge along the barrel axis, no ramping is required during chambering because the cartridge is already aligned with the barrel axis before advancing it into the chamber.

The gun utilizing the no ramping of the cartridge concept of the present invention ha an actuator that moves rearward by a gas piston or other operating means. In moving rearward the actuator contacts the beveled surface of the bolt and cams the bolt, with its spring loaded rammer down out of engagement with a locking recess in the receiver. The bolt is cammed completely out of the chambering path to the barrel. Rearward movement of the carrier carries the bolt and bolt carrier rearward. The actuator operates a feed mechanism in a conventional manner to advance a cartridge through the feedway into a position at the rear of the chambering path directly behind the chamber of the barrel. The only moving part remaining in the chambering path is a spring loaded rammer which is pushed down by the incoming cartridge, as feeding takes place while the bolt and associated parts move rearward. When the bolt is moved forward by the drive spring or other means the spring loaded rammer will contact the base of the cartridge and carry it straight forward into the chamber of the barrel. When the bolt comes fully forward, the cam surface of the actuator forces the bolt up into engagement with the locking recess in the receiver. The gun is then fully locked and ready to fire through a conventional firing mechanism.

A gun sing the present invention has an axially moveable bolt which, when unlocked, is removed form the path of the incoming cartridge so that the cartridge can be moved from its feed position directly along the axis of the bore into the chamber. The actuator which holds the bolt in locked position, through a camming surface on the actuator, unlocks and lowers the bolt out of the path of the feedway of the next cartridge being chambered. During the cycle of operation the bolt angles out of the way and "disappears" form the path of incoming ammunition and then reappears behind the chambered cartridge to lock it in place for firing. The present invention thus provides for a novel and reliable feeding and chambering system based upon the disappearing bolt.

DESCRIPTION OF ILLUSTRATIVE EMBODIMENT

Figure 1:
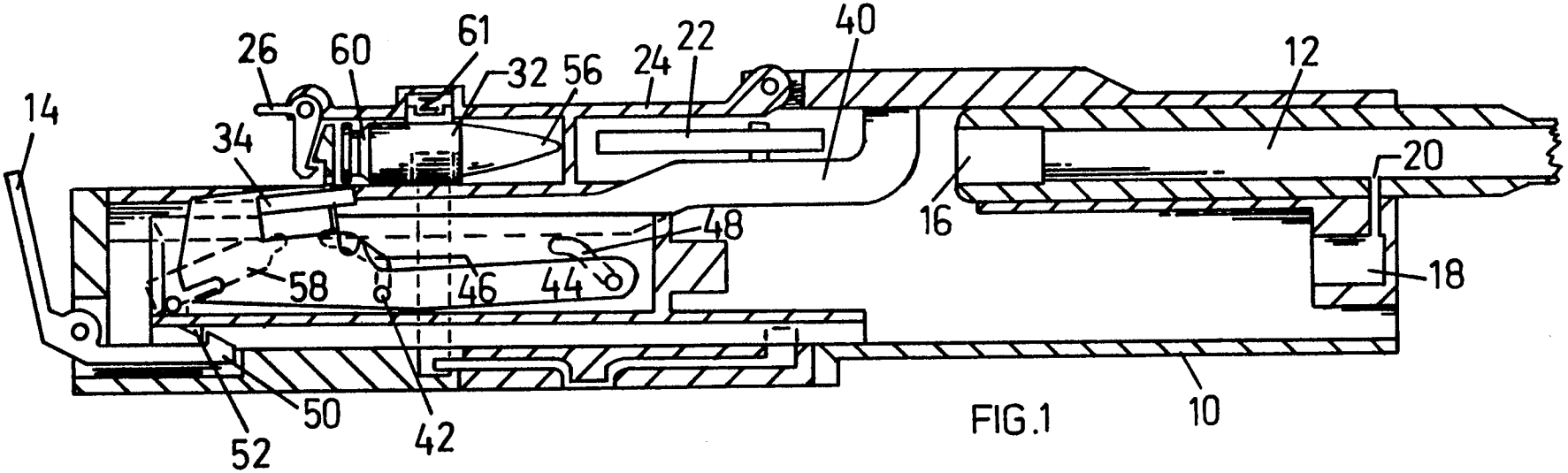
FIG. 1 is a side view of the gun in cocked condition ready to chamber and fire a cartridge when the trigger is depressed.

Referring now to FIG. 1 there is shown a side view, in section, a gun frame 10 with barrel 12 pointing to the right with trigger 14 at the left. Chamber 16, gas cylinder 18 with gas port 20, ejector 22, feed cover 24 and feed cover catch 26 are shown for identification and orientation purposes and can have other configurations without effecting the mechanisms comprising the present invention.

Figure 2:
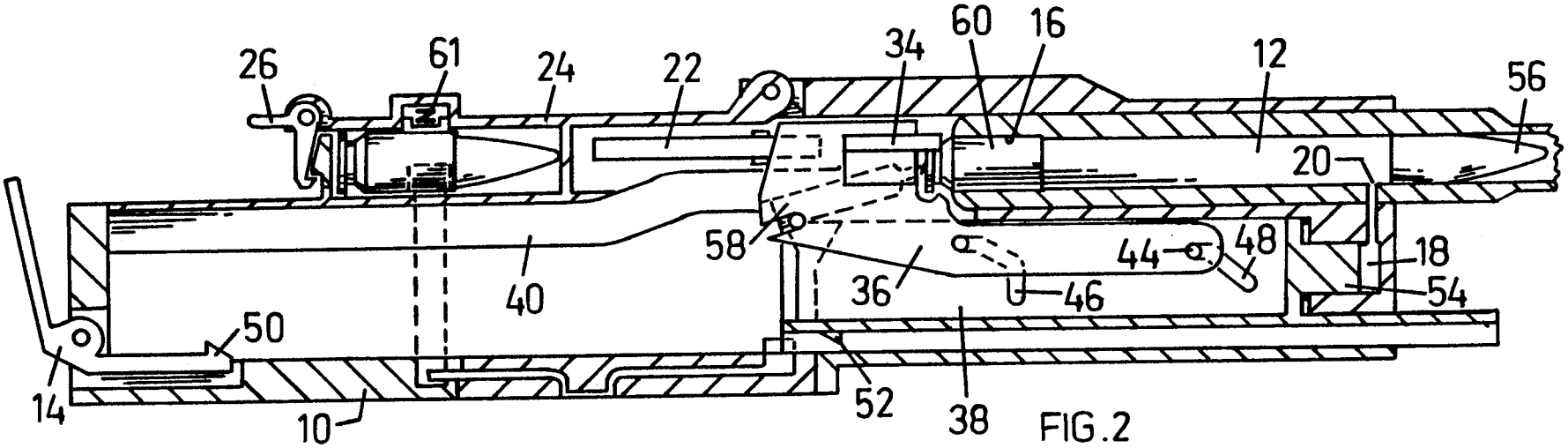
FIG. 2 is a side view of the gun in the act of firing.
Figure 3:
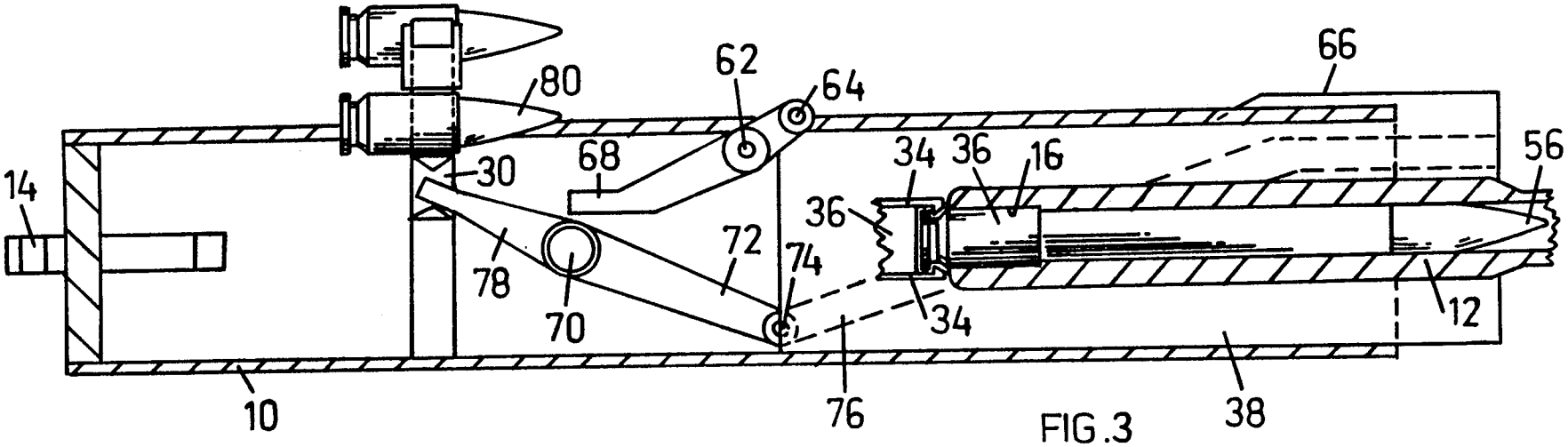
FIG. 3 is a top view of the gun in the act of firing with parts in the same position as in FIG. 2.
Figure 5:
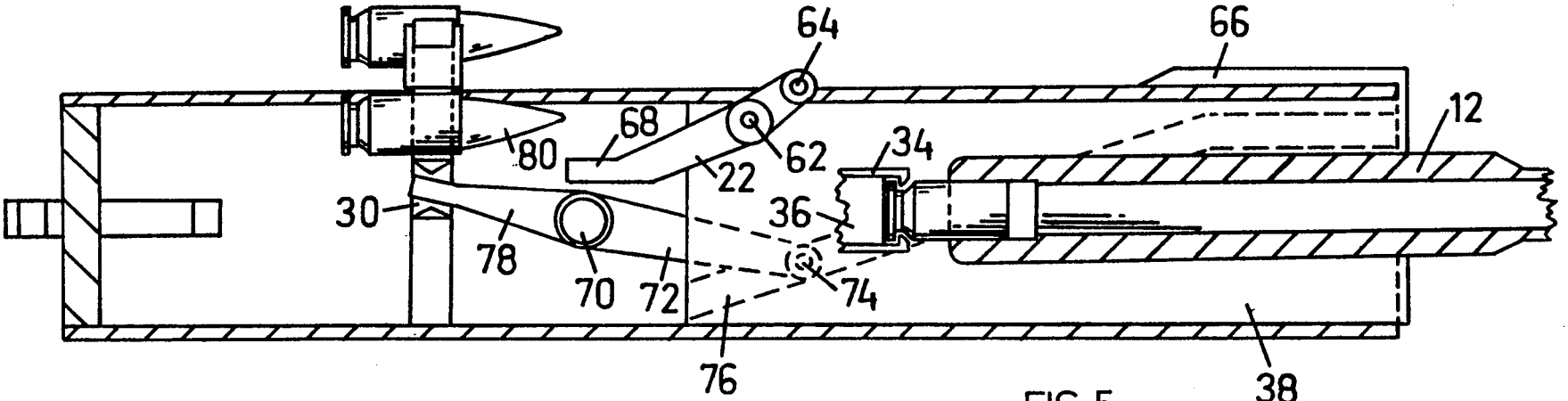
FIG. 5 is a top view of the structure in FIG. 4.
Figure 7:
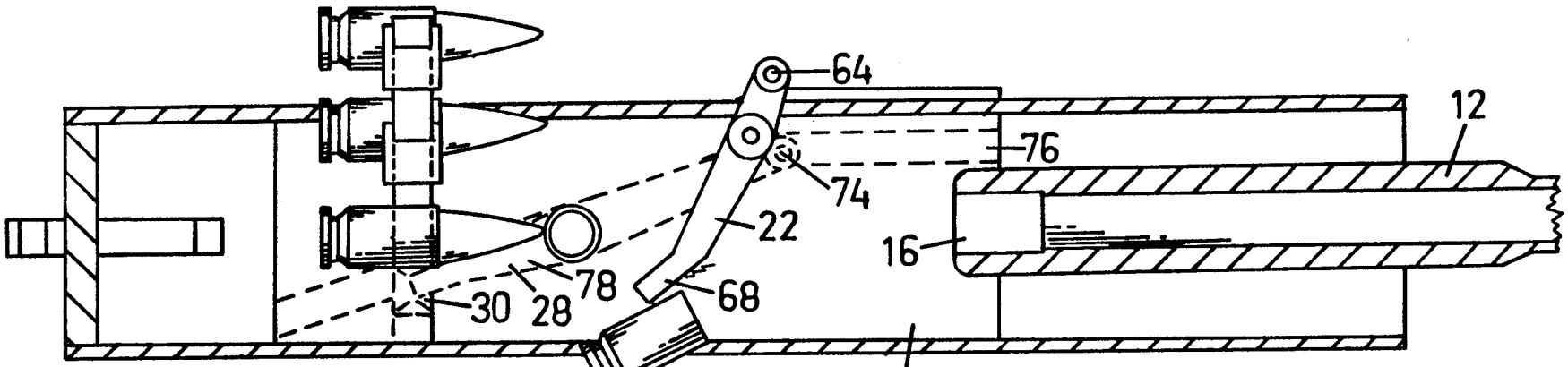
FIG. 7 is a top view of the parts as positioned in FIG. 6.

Gun frame 10 needs to accomodate a feed lever 28 which moves the feed slide 30, shown in FIGS. 3,5 and 7, to position the next cartridge 32 between extractor 34 on bolt 36 to chamber it in chamber 16 prior to firing. Bolt 36 is carried fore and aft by bolt carrier 38. They are connected in a pin and slot arrangement such that with foreward movement bolt 36 follows bolt cam path 40 upwardly to chamber cartridge 32 into chamber 16 as shown in FIG. 2. Pins 42,44 on bolt 36 engage arcuate slots 46,48 on bolt carrier 38 at their bottoms in FIG. 1 and at their tops in FIG. 2.

In FIG. 1 the bolt carrier 38 is held rearwardly by trigger catch 50 engaging projection 52 on bolt carrier 38. When trigger 14 is pressed forewardly catch 50 moves down from projection 52. A spring, not shown, drives bolt carrier 38 forwardly to its forward position shown in FIG. 2. Gas piston 54 at the front of bolt carrier 38 is in gas cylinder 18 in frame 10 where gases behind projectile 56 in barrel 12 pass through gas port 20 and into gas cylinder 18 to drive the bolt carrier 38 rearwardly again. When bolt carrier 38 moved from its position in FIG. 1 to its position in FIG. 2, firing pin 58 on bolt carrier 38 strikes the rear end of casing 60, firing projectile 56 from barrel 12 as shown in FIG. 2.

Figure 4:
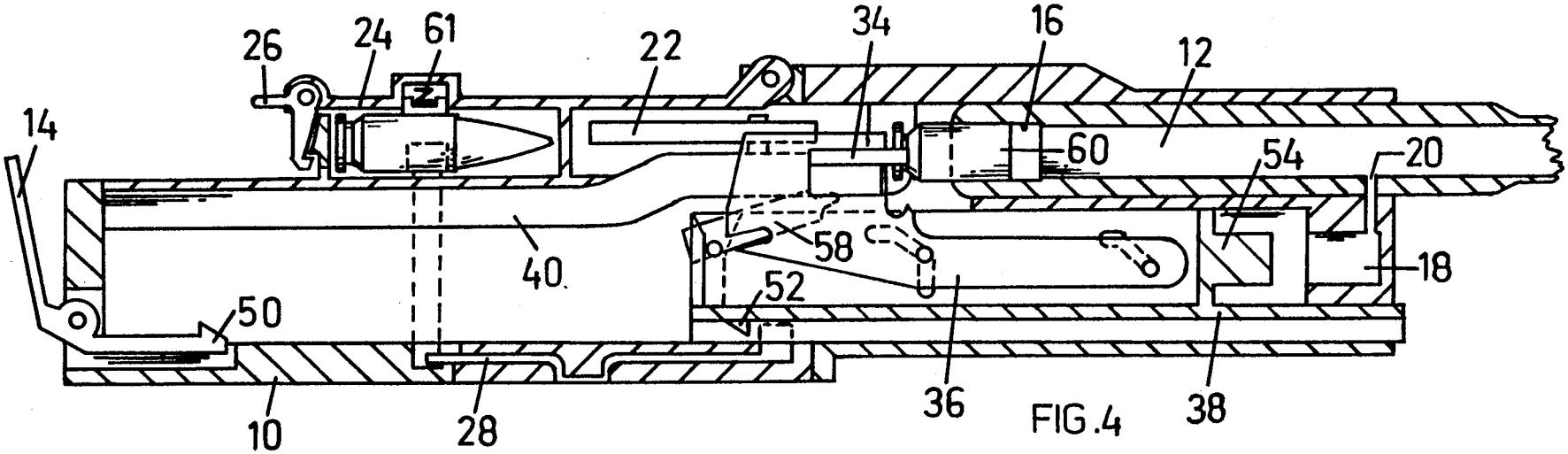
FIG. 4 is a side view with the bolt unlocked and the empty cartridge case being extracted and the feeder bringing in a fresh cartridge into the feedway.
Figure 6:
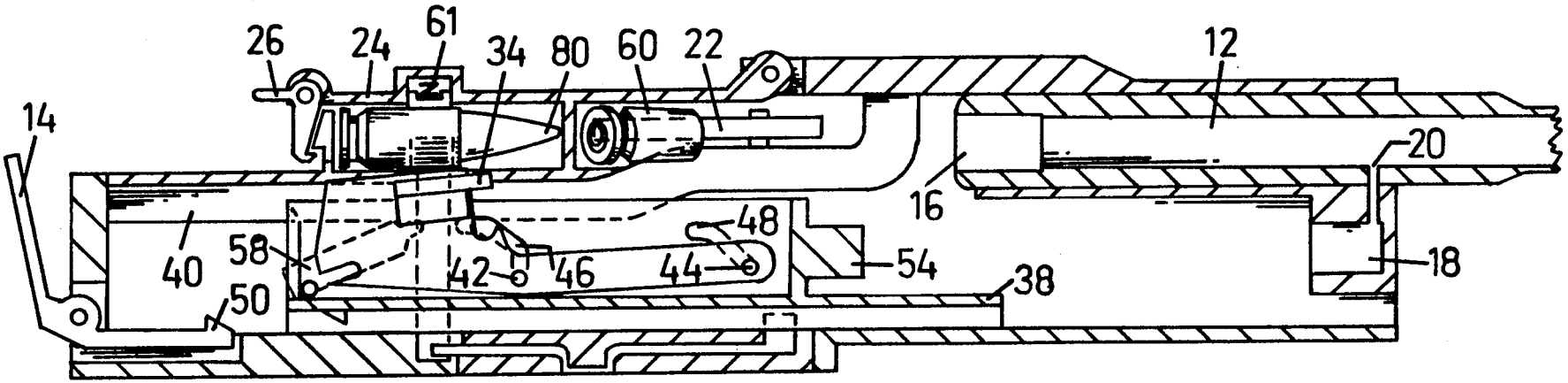
FIG. 6 is a side view showing the ejection of the spent case and the fully fed fresh cartridge in the feedway.

A description of the cartridge feeding mechanisms as set forth in FIGS. 3,5 and 7 is deferred until a description of the cycling of the bolt carrier 38 is completed with reference to FIGS. 4 and 6. In FIG. 4 the bolt carrier 38 is on its way rearward as a result of gases from barrel 12 passing through gas port 20 to pressurize gas cylinder 18 and drive gas piston 54 on bolt carrier 38 rearwardly. Firing pin 58 has moved back and down from casing 60 and extractor 34 has started the withdrawal of casing 60 from chamber 16. Pin 44 on bolt 36 has moved to the bottom of slot 48 on bolt carrier 38. Pin 42 on bolt 36 has moved partway down slot 46 on bolt carrier 38. It is these relative movements between the bolt 36 and bolt carrier 38 in their backward movement that place the firing pin 58 and extractor 34 to the positions shown. Bolt carrier 38 move straight back while bolt 36 follows the bolt cam path 40. This causes the bolt 36 to drop down and "disappear" from the chamber axis and let the next cartridge be chambered without ramping.

In FIG. 6 the rearward movement of bolt 36 is almost complete and empty casing 60 is in process of being ejected. The bolt carrier 38 is almost back to its original position shown in FIG. 1. Pin 42 on bolt 36 is now at the bottom of slot 46 on bolt carrier 38 as bolt 36 follows bolt cam path 40 which at its rearward portion is substantially straight and level. After the rearward movement of bolt 36 is complete, spring 61 urges cartridge 80 downward in front of the bolt for advancement thereby when the bolt advances.

FIGS. 3,5 and 7 show structure for feeding, extracting and ejecting cartridges and their relationship to the bolt and bolt carrier movement in FIGS. 2,4 and 6. The position of the structure in FIG.3 corresponds to the position of that structure in FIG. 2. In both views casing 60 is in the barrel chamber 16 and projectile 56 is shown moved past the gas port. The position of bolt carrier 38 is the same in both FIGS. A fragmentary view of extractor 34 and bolt 36 against the end of casing 60 is shown for location purposes but details of bolt 36 and bolt carrier have been omitted from FIG. 3 in order to show how the feeding, extracting and ejecting structure works.

The ejector 22 is pivotally mounted at pivot 62 to frame 10 and has a roller 64. An ejector cam 66 on moveable bolt carrier 38 causes it to rotate counterclockwise in FIGS. 3,5 and 7 as bolt carrier 38 moves rearwardly, to the left in these views. The end 68 ejects the empty cartridge case 60 as shown in FIG. 7. When bolt carrier 38 moves forwardly (from FIG. 6 to FIG.4 to FIG. 2) the ejector 22 rotates clockwise from its position in FIG. 7 to that in FIG. 5 and FIG. 3.

FIGS. 3, 5 and 7 also illustrate how cartridges are moved from their feedbelt to a position in front of the bolt, ready for chambering without ramping. Again, FIG. 3 shows projectile 56 at the end of barrel 12 and casing 60 still in chamber 16 in front of bolt 36 and extractor 34. Feed lever 28 is pivotally mounted at pivot 70 on frame 10. This feed lever 28 has a forward arm 72 having roller 74 engageable in feed cam path 76 on bolt carrier 38. Feed lever 28 has a rearward arm 78 which engages and actuates feed slide 30. This feed slide 30 moves the cartridge belt so as to position the next cartridge 80 on the barrel axis in front of bolt 36 and between the arms of extractor 34, as shown in FIG. 1, ready for chambering.

As bolt carrier 38 moves rearwardly,to the left in FIG. 1, in an upward direction as shown in FIG. 5. This moves rearward arm 78 laterally and thus feed slide 30 downwardly in FIG. 5, to their positions shown in FIG. 7, where the next cartridge 80 is in axial alignment with chamber 16 and barrel 12. At this point all parts and their movements described heretofore relative to cartridge 32 are repeated relative to the next cartridge 32 are repeated relative to the next cartridge 80, and subsequent cartridges until the cartridge belt is emptied or until trigger 14 is released.

Having described an illustrative embodiment of the invention, it is to be understood that variations will occur to one skilled in the art and that such variations and deviations are to be considered as part of this invention as set forth in the following claims.

What is claimed is:

1. A weapon with disappearing bolt comprising:
a gun frame having a gun barrel thereon,
said gun barrel having a bore therein through which projectiles pass when cartridges are fired,
said bore having an axis extending therethrough,
a bolt carrier in said gun frame having said bolt mounted therein, said bolt carrier being adapted for forward and rearward movement in said gun frame,
a feed lever mounted on said gun frame,
said bolt carrier having a feed cam path thereon,
said feed lever being engageable with said cam path for movement as said bolt carrier moves in said forward and rearward movement in said gun frame,
said movement of said feed lever being operable to move cartridges into said gun frame and onto said axis of said bore,
said bolt being operable to move said cartridges along said bore axis to said bore.

2. A weapon with disappearing bolt as set forth in claim 1 wherein said feed lever is pivotally mounted on said gun frame and has pivotal movement as said bolt carrier moves in said forward and rearward movement.

3. A weapon with disappearing bolt as set forth in claim 2 wherein said forward movement of said bolt carrier moves said feed lever to retrieve another cartridge and subsequent rearward movement of said bolt carrier positions said another cartridge for chambering on said axis of said bore.

4. A weapon with disappearing bolt as set forth in claim 1 wherein said bolt and bolt carrier have pin and slot connections whereby said bolt is moved downwardly as said bolt carrier is moved rearwardly.

5. A weapon with disappearing bolt as set forth in claim 4 wherein said bolt is moved upwardly as said bolt carrier is moved forwardly.

6. A weapon with disappearing bolt as set forth in claim 4 wherein said gun frame has a bolt cam path thereon for regulating bolt elevation with bolt carrier position.

* * * * *